United States Patent [19]

Shimizu et al.

[11] Patent Number: 4,518,380

[45] Date of Patent: May 21, 1985

[54] PAPER FOLDING DEVICE

[75] Inventors: Masaaki Shimizu, Tokyo; Akira Aihara, Kyoto, both of Japan

[73] Assignee: Horizon Co., Ltd., Kyoto, Japan

[21] Appl. No.: 581,696

[22] Filed: Feb. 21, 1984

Foreign Application Priority Data

Feb. 28, 1983 [JP] Japan ..... 58-33288

[51] Int. Cl.[3] ..... B31B 1/64

[52] U.S. Cl. ..... 493/420

[58] Field of Search ..... 493/419, 420, 421, 453; 181/200

[56] References Cited

U.S. PATENT DOCUMENTS 4,270,909 6/1981 Ireland ..... 493/420

4,336,862 6/1982 Adam ..... 493/420

*Primary Examiner*—Leon Gilden

*Attorney, Agent, or Firm*—Christensen, O'Connor, Johnson & Kindness

[57] ABSTRACT

A paper folding device wherein two wing members are supported for pivotal movement between an open and a closed position, with a gap formed between the two wing members in the closed position. A sheet of paper to be folded is fed into the gap by rollers until the forward edge of the paper hits an adjustable stopper in the gap, so that as the sheet is farther moved by the rollers, a portion of the sheet outside the gap is bent, and the bent portion is nipped and then folded by the rollers. A sound absorber is so arranged adjacent each of the two wing members so as to absorb the sound caused by the forward edge of the sheet of paper striking the stopper inside the gap.

7 Claims, 8 Drawing Figures

PAPER FOLDING DEVICE

BACKGROUND OF THE INVENTION

This invention relates to a paper folding device.

There is known a paper folding device comprising a pair of parallel wings arranged face to face across a small gap of a width enough for a sheet of paper to enter into, with a stopper disposed in the gap in such a manner that the stopper can be displaced in the direction of insertion of the paper into the gap.

When the forward edge of the sheet of paper entering the gap hits the stopper inside the gap, the sheet cannot advance farther into the gap but the middle portion of the sheet adjacent the entrance opening of the gap is bent, and the bent portion comes to be nipped by a pair of nip rollers arranged adjacent the entrance opening of the gap, so that the sheet of paper is folded into two portions as it is passed through the nip rollers. The shape of the folded sheet of paper depends upon the position of the stopper or the distance between the stopper and the entrance of the gap.

In the paper folding device of the above-mentioned type, since the sheet of paper to be folded is fed at a high speed, a very big noise is caused by the forward edge of the sheet striking the stopper. Particularly in a high-speed paper folding machine, the sheet runs at a high speed with a short cycle of feeding, so that the above-mentioned striking sound is very high and is repeated continuously in a short cycle. The sound is so high that it is almost impossible to hear ordinary human voice adjacent the running machine. Therefore, it is required that the device should be provided with means for soundproofing. To meet the requirement, it has been proposed to put the whole paper folding device in a soundproof box and tightly close the opening of the box by a cover. Indeed the arrangement is effective in sound isolation. However, if the position of the stopper is to be adjusted in order to fold a sheet of paper into a different pattern, it is necessary to take the paper folding device out of the soundproof box and change the position of the stopper and then again put the device into the box. This is very troublesome and time-consuming. Similarly, whenever the gap in the device is stuffed with paper, the device must be taken out of the soundproof box for removing the paper from the gap.

SUMMARY OF THE INVENTION

Accordingly, the primary object of the invention is to provide a paper folding device provided with means for soundproofing which enables easy adjustment of the stopper and removal of paper with which the gap of the device has been stuffed.

Briefly, the device of the invention comprises a pair of wing members; means for holding each of the wing members for pivotal movement between an open position and a closed position; a gap formed between the two wing members in the closed position, the gap being dimensioned so that a sheet of paper to be folded may be inserted into the gap; a stopper disposed in the gap so as to be displaceable in the direction of movement of the sheet of paper inside the gap; a pair of sound absorbing members each arranged behind one of the pair of wing members for simultaneous opening and closing movement therewith; and roller means arranged adjacent the entrance of the gap for feeding a sheet of paper to be folded into the gap and folding the sheet of paper at a bent portion caused outside the gap upon hitting of the forward edge of the sheet of paper on the stopper inside the gap.

The invention will be described in detail with reference to the accompanying drawing.

DESCRIPTION OF THE PREFERRED EMBODIMENT

Figure 1:
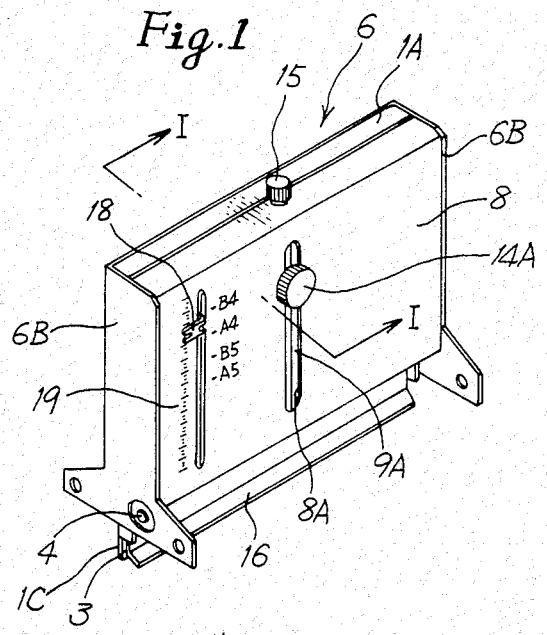
FIG. 1 is a perspective view of one embodiment of the invention.

Referring in detail to the drawings, there are shown a pair of wing members 1 and 2 so arranged that their planes are in parallel with each other and face across a gap 3 into which a sheet of paper to be folded can be inserted. The wing member 2 is connected to the corresponding edge of the wing member 1 by means of a shaft 4 in the manner to be described later, so that the two wing members 1 and 2 are pivotable about the shaft 4 relative to each other so as to be opened or closed as will be described later in detail.

Three spacer plates 5 are provided at the three peripheral sides of the wing member 2 except the bottom side thereof so that the gap 3 is formed when the two wing members 1 and 2 are closed. The spacers 5 may be made of, e.g., magnetic rubber, so that when the wing members 1 and 2 are closed, the spacers 5 attract the wing member 1 and keep the two members 1 and 2 closed. Under the condition, the spacers 5 close the peripheral edges of the gap 3 except for the lower edge thereof thereby to prevent the previously mentioned striking sound from leaking out of the gap 3.

The wing member 1 is mounted on a frame 6. In particular, the frame 6 has a main wall 6A in parallel with which the wing member 1 lies, with a sound-absorbing member 7 being interposed between the back surface of the wing member 1 and the inner surface of the main wall 6A of the frame 6. The upper portion 1A of the wing member 1 is bent so as to cover the upper edge surface of the sound-absorbing member 7.

The other wing member 2 is set in a box-like case 8. In particular, the wing member 2 covers the front opening of the case 8, in which a sound-absorbing member 9 is set so as to face the back surface of the wing member 2.

The frame 6 has its opposite lateral side portions so bent as to form opposite lateral side walls 6B, which cover the lateral side edge surfaces of the sound-absorbing member 7, and between which the box-like case 8 is fitted upon closing of the frame 6 and the case 8, thereby to increase the effect of soundproofing.

The wing member 1 is formed with a plurality of parallel slots 1B. Similarly, the other wing member 2 is formed with a plurality of parallel slots 2A corresponding to the paralled slots 1B. Each of the slots 1B faces one of the slots 2B when the two wing members are closed.

In the gap 3 there is provided a stopper 10, which is displaceable within the gap in the direction of movement of the sheet of paper and can be fixed at any desired displaced position.

The stopper 10 comprises a cross bar 10B formed with a plurality of fingers 10A spaced a distance apart from each other along the length of the bar. The bar 10B is arranged behind the wing member 2 in the room 8B of the box-like case 8, with the fingers 10A extending through the slots 2B in the wing 2 across the gap 3 into the slots 1B in the opposite wing member 1.

A vertically extending guide rod 12 is disposed in the room 8B of the case 8 and passed through the stopper 10 perpendicularly thereto, so that the stopper 10 with the fingers 10A is displaceable along the guide rod 12. A nut 13 is fixed to the cross bar 10B of the stopper 10 and a set screw 14 is threaded through the nut 13. The set screw 14 extends through a slot 9A formed in the sound absorber 9 and a corresponding slot 8A formed in the back wall of the case 8 and is provided with a knob 14A outside the case 8.

When the knob 14A is turned manually to move the screw 14 inwardly, the inner end of the screw presses the guide rod 12 into tight engagement with the hole (not shown) of the stopper 10 through which the guide rod 12 passes, thereby to fix the stopper 10 at the position along the length of the guide rod 12.

Figure 4:
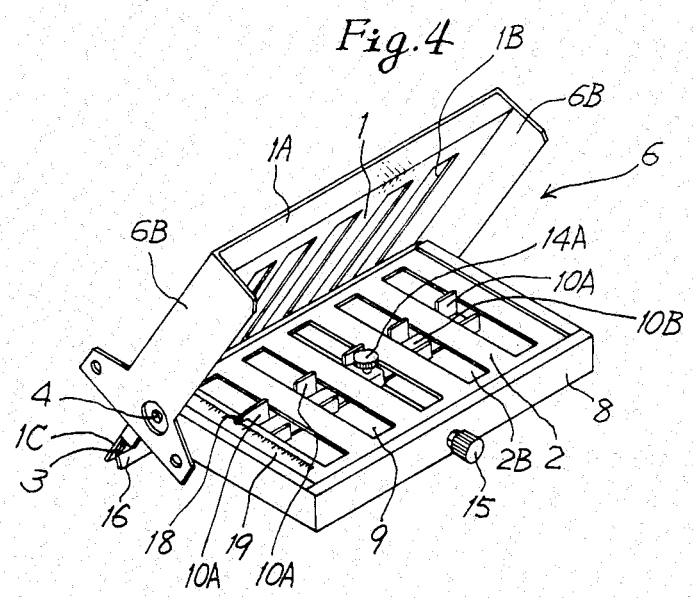
FIG. 4 is a view similar to FIG. 3 but showing another embodiment of the invention.

In the illustrated embodiment, since the set screw 14 extends through the slot 9A in the sound absorber 9 and the slot 8A in the back wall of the case 8, noise may well leak out through the slots 9A and 8A. To prevent any such leakage, the screw 14 may be so arranged that the knob 14A is positioned in the gap 3 as shown in FIG. 4.

For fine adjustment of the position of the stopper 10 that has been fixed to the guide rod 12, the guide rod is so arranged that by turning a knob 15 the guide rod 12 can be slightly displaced in the axial direction by a known mechanism for fine adjustment of the position or height of the stopper 10 carried by the rod 12.

The wing member 1 has a lower end portion lC downwardly projecting from the lower end of the frame 6, and a guide plate 16 is arranged adjacent the entrance of the gap 3 so as to face the downwardly projecting portion lC of the wing member 1. Adjacent the guide plate 16 and the projecting end IC of the wing member 1 there are arranged three rollers 17A, 17B, 17C.

Figure 5:
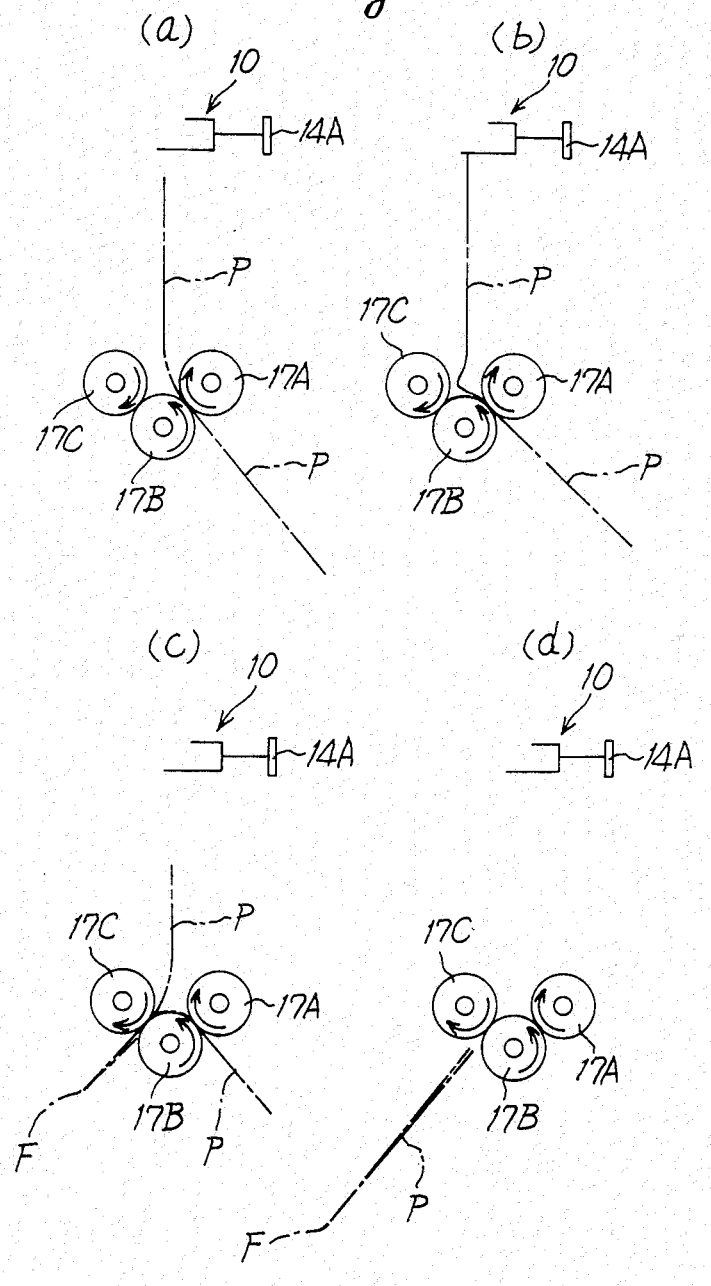
FIGS. 5*a* through 5*d* schematically show different steps of the paper folding operation by the device of the invention.

As shown in FIG. 5*a*, a sheet of paper P is nipped by the rollers 17A and 17B rotating in the directions as shown by the arrows so as to be fed into the gap 3 until the forward edge of the sheet hits the stopper 10 so that the sheet is prevented from advancing farther into the gap, whereupon a portion of the sheet adjacent the entrance opening of the gap 3 is bent (FIG. 5*b*) and the bent portion is then nipped between the rollers 17B and 17C rotating in the directions shown by the arrows (FIG. 5*c*), and as the sheet of paper is passed between the rollers 17B and 17C, it is folded into two halves with a folded edge F having been formed along the nipped portion (FIG. 5*d*). The folding operation is the same as with the conventional devices.

A pointer 18 is attached to the stopper 10 to indicate the position of the stopper 10 and consequently the size of the folded sheet of paper on a scale 19 on the outer wall surface of the case. The same scale 19 is provided on the inner surface of the wing member 2 as shown in FIG. 4, with a pointer 18 formed on the adjacent stopper finger 10A.

Figure 2:
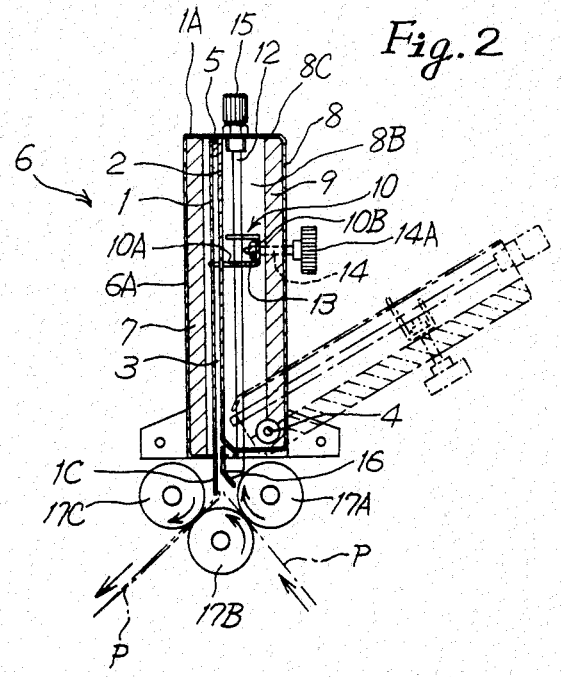
FIG. 2 is a sectional view taken on line I—I in FIG. 1.

In operation, the wing members 1 and 2 together with the frame 6, the case 8 and the sound absorbers 7 and 9 are closed as shown in FIG. 1 or 2. A sheet of paper is fed into the gap 3 and folded in the above-mentioned manner. As the forward edge of the sheet of paper collides with the stopper fingers 10A, a noisy sound is produced. A substantial portion of the sound energy is absorbed by the sound absorbers 7 and 9 provided behind the wing members 1 and 2, so that the level of the noise leaking outside the box is greatly reduced. There is no substantial difference in the effect of sound isolation between the arrangement of the invention and the conventional arrangement that the whole device is enclosed in a soundproof box.

For adjustment of the stopper 10, the knob 14A is turned to loosen the set screw 14 and displace it along the guide rod 12. In the embodiment of FIG. 4 wherein the knob 14A is inside the case 8, the case 8 is opened as shown to expose the knob 14A for ready adjustment of the position of the stopper 10.

Figure 3:
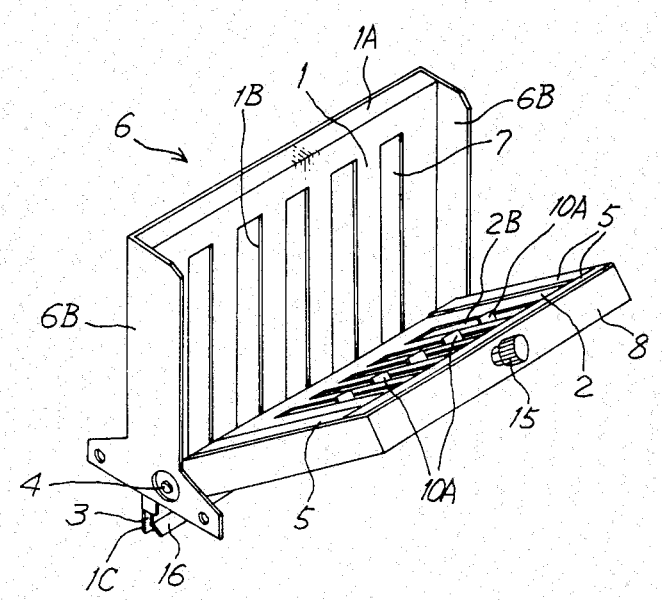
FIG. 3 is a perspective view of the device of FIG. 1 shown in an open condition.

If the gap 3 is stuffed with a sheet of paper in the course of folding operation, the case 8 is opened as shown in dot-and-dash line in FIG. 2 or in solid line in FIGS. 3 and 4 to expose the gap 3 for easy removal of any sheet of paper with which the gap has been stuffed. It is not necessary to remove the sound absorbing members from within the device as was necessary in the known devices.

It has now become apparent that a simple operation of opening the case 8 suffices for adjustment of the position of the stopper 10 or removal of a sheet of paper form the gap 3 while providing a high degree of sound isolation.

What we claim is:

1. A device for folding a sheet of paper, comprising:

a pair of wing members;

means for holding each of said wing members for pivotal movement between an open position and a closed position;

a gap formed between said wing members in said closed position, said gap being dimensioned so that a sheet of paper to be folded may be inserted into said gap;

a stopper disposed in the gap so as to be displaceable in the direction of movement of said sheet of paper inside said gap;

a pair of sound absorbing members each arranged behind one of said pair of wing members for simultaneous opening and closing movement therewith; and roller means arranged adjacent the entrance of said gap for feeding a sheet of paper to be folded into said gap and folding said sheet of paper at a bent portion caused outside said gap upon hitting of the forward edge of said sheet of paper on said stopper inside said gap.

2. The device of claim 1, further including a plurality of spacer plates fixed to the periphery of one of said wing members for defining the width of said gap when said wing members are in said closed position.

3. The device of claim 1, wherein said stopper comprises a guide rod supported by one of said wing member holding means and extending in the direction of movement of said sheet of paper in said gap, a cross bar formed with a plurality of stopper fingers transversely extending across said gap and a set screw for fixing said cross bar to said guide rod at a selected position along the length thereof.

4. The device of claim 3, wherein said guide rod with said stopper having been fixed thereto is displaceable in the axial direction for fine adjustment of the position of said stopper.

5. The device of claim 3, wherein said set screw extends through said sound absorbing member to terminate in a knob outside said device, so that said knob is manipulated to displace said stopper along said guide rod and fix said stopper to a desired position.

6. The device of claim 3, wherein said set screw is provided with a knob generally inside said gap, so that said knob is manipulated to displace said stopper along said guide rod and fix said stopper to a desired position.

7. The device of claim 1, wherein said means for holding one of said wing members comprises a frame and said means for holding the other of said wing members comprises a case connected to said frame by a common shaft so that said frame and said case are pivotable about said shaft relative to each other into said open or closed position.

* * * * *